US007806494B2

(12) United States Patent
Shindo

(10) Patent No.: US 7,806,494 B2
(45) Date of Patent: Oct. 5, 2010

(54) RECORDING APPARATUS

(75) Inventor: Tatsuya Shindo, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 557 days.

(21) Appl. No.: 11/906,617

(22) Filed: Oct. 3, 2007

(65) Prior Publication Data

US 2008/0136850 A1 Jun. 12, 2008

(30) Foreign Application Priority Data

Oct. 4, 2006 (JP) ..... 2006-272807

(51) Int. Cl.
*B41J 25/308* (2006.01)
*B41J 2/165* (2006.01)

(52) U.S. Cl. ..... 347/8; 347/22

(58) Field of Classification Search ..... None
See application file for complete search history.

(56) References Cited

U.S. PATENT DOCUMENTS 5,291,227 A 3/1994 Suzuki
5,608,430 A * 3/1997 Jones et al. ..... 347/8
6,315,468 B2 * 11/2001 Kishida et al. ..... 400/55

FOREIGN PATENT DOCUMENTS

JP 2003034057 2/2003

* cited by examiner

*Primary Examiner*—Omar Rojas
(74) *Attorney, Agent, or Firm*—Frommer Lawrence & Haug LLP

(57) ABSTRACT

A recording apparatus comprises a recording head having nozzle holes formed on a nozzle surface which is placed opposite to a recording medium; a platen disposed opposite to the recording head; a cleaner for cleaning the nozzle surface of the recording head in predetermined cycles; a gap adjusting unit for adjusting a gap between the nozzle surface of the recording head and the platen; and a control unit for controlling an operation of the gap adjusting unit. The control unit includes a measuring unit for measuring a value indicating a recording amount of recording performed on the recording medium. The control unit is configured to change a first predetermined gap to a second predetermined gap larger than the first predetermined gap when a specified timing at which a value indicating the recording amount exceeds a predetermined value arrives after the cleaner has cleaned the nozzle surface.

9 Claims, 8 Drawing Sheets

RECORDING APPARATUS

TECHNICAL FIELD

The present invention generally relates to a recording apparatus that is capable of adjusting a gap between a recording head that records an image on a surface of a recording medium such as paper by ejecting ink thereon, and a platen disposed opposite to the recording head.

BACKGROUND OF THE INVENTION

As an example of a recording apparatus, there is an ink jet printer that ejects ink from a recording head to form an image on recording paper. The ink jet printer is configured in such a manner that a sheet of the recording paper trapped between a pair of feeding rollers is transferred to downstream side by rotation of the rollers and is placed opposite to the recording head so as to be supported by a platen from a rear surface side. The recording head has a nozzle surface opposite to the recording paper and nozzle holes are open on the nozzle surface to eject ink there from. In a state where the paper supported by the platen is placed opposite to the nozzle surface, the ink is ejected from the nozzle holes and adhere onto the surface of the recording paper to form an image thereon.

In order to improve precision of adhesion position of the ink on the recording paper, it is desirable to set a gap between the recording head and the recording paper narrower. Especially, in a case where an image having a quality substantially equal to that of silver halide photography is printed, it is necessary to position the recording head and the recording paper in close proximity to each other. For this reason, the platen for supporting the recording paper during printing is disposed opposite to and relatively closer to the recording head.

In general, fine paper powder adhere to the recording paper. The paper powder, coming off from the recording paper, may float and stay near the recording head, or otherwise may be deposited on the surface of the platen. The floating paper powder, and the paper powder deposited on the surface of the platen and thereafter scattered by air flow or the like are likely to adhere to the nozzle holes of the recording head. Such a circumstance is unfavorable because ejection performance of the ink from the nozzle holes will become unstable. As a matter of course, adhesion of the paper powder onto the nozzle holes occurs more frequently when the recording paper is positioned closer to the recording head.

To solve the above described problem, Japanese Laid-Open Patent Application Publication No. 2003-34057 discloses an image recording apparatus in which a suction fan or the like suctions floating substances or matters containing ink mist to capture them in an ink capturing element formed of sponge and others.

However, since the image recording apparatus disclosed in the Publication No. 2003-34057 is equipped with the suction fan and the ink capturing element formed of the sponge and others in a suction passage, a structure of the apparatus becomes intricate and a size of the entire apparatus is difficult to reduce. In addition, a manufacturing cost of the entire apparatus becomes high and a running cost increases with an increase in a power consumption amount.

Since the suction fan has a driving unit such as a motor, slight vibration is generated by driving of the motor and others during recording. The vibration may be transmitted to the recording paper via the platen provided with the suction fan. Undesirably, such a circumstance makes the adhesion position of the ink ejected from the recording head onto the recording paper unstable, making it difficult to improve the precision of the adhesion position.

In general, in the ink jet printer, the nozzle surface of the recording head is cleaned in specified cycles by using a cleaner blade to remove foreign matters adhering onto the nozzle surface. However, the cleaning of the nozzle surface using the cleaner blade may cause damage to the nozzle surface or wear-out of a water-repellent film on the nozzle surface, deteriorating ink ejection performance, or may interrupt a recording operation being carried out, degrading operation efficiency. For these reasons, it is undesirable to frequently carry out the cleaning of the nozzle surface using the cleaner blade.

SUMMARY OF THE INVENTION

The present invention has been developed under the circumstances, and an object of the present invention is to provide a recording apparatus that is capable of preventing adhesion of paper powder onto nozzle holes with a simple configuration, and does not substantially cause deterioration of ink ejection performance and reduction of operation efficiency.

According to the present invention, there is provided a recording apparatus comprising a recording head for ejecting ink from nozzle holes formed on a nozzle surface to record an image on a surface of a recording medium, the nozzle surface being placed opposite to the recording medium; a platen disposed opposite to the recording head, for supporting the recording medium from a rear surface side; a cleaner for cleaning the nozzle surface of the recording head in predetermined cycles; a gap adjusting unit for adjusting a gap between the nozzle surface of the recording head and the platen in such a manner that one of or both of the recording head and the platen is moved; and a control unit for controlling an operation of the gap adjusting unit; wherein the control unit includes a measuring unit for measuring a value indicating a recording amount of recording performed on the recording medium, and wherein the control unit is configured to, in a state where the gap between the nozzle surface and the platen is set to a first predetermined gap, change the first predetermined gap to a second predetermined gap larger than the first predetermined gap when a specified timing at which the value indicating the recording amount exceeds a predetermined value arrives after the cleaner has cleaned the nozzle surface.

It is empirically known that paper powder is generated from recording paper in relatively large amount when the value indicating the recording amount of the recording medium exceeds the predetermined value. Therefore, by increasing the gap between the nozzle surface of the recording head and the platen at this timing, it becomes possible to suppress adhesion of the paper powder to the nozzle surface. In addition, since it is not necessary to increase the frequency with which the cleaner cleans the nozzle surface, damage to the nozzle surface and wear-out of a water-repellent film on the nozzle surface can be suppressed. Furthermore, recording operation efficiency is not reduced.

The measuring unit may be configured to measure a recording number of the recording medium. The timing may arrive when the recording number of the recording medium that is measured by the measuring unit becomes a predetermined value after the cleaner has cleaned the nozzle surface. In such a configuration, since the gap between the nozzle surface and the platen is adjusted under the condition in which the number of recording medium that has been subjected to image recording in a location opposite to the recording head is a reference, correct timing is gained. As a result, adhesion of the paper powder to the nozzle holes is effectively suppressed.

The measuring unit may be configured to measure a recording time during which the recording medium is subjected to recording. The timing may arrive when the recording time that is measured by the measuring unit becomes a predetermined value after the cleaner has cleaned the nozzle surface. In such a configuration, the gap is adjusted at correct timing, and as a result, adhesion of the paper powder to the nozzle holes is effectively suppressed.

The control unit may be configured to operate the gap adjusting unit to change the second predetermined gap between the nozzle surface and the platen to the first predetermined gap, when the cleaner cleans the nozzle surface in a state where the gap between the nozzle surface and the platen is set to the second predetermined gap. In such a configuration, the gap between the nozzle surface and the platen can be reduced according to the recording content, for example, photo image quality, after the cleaner has cleaned the nozzle surface. Thus, adhesion position precision of the ink ejected to the recording medium is not reduced.

The platen may include a platen body and a support portion that is provided closer to the recording medium than the platen body, for supporting the recording medium. The support portion may have a plurality of contact portions that contact a rear surface of the recording medium, and a space may be formed between the contact portions so as to expose a surface of the platen body. An adhesive may be provided on the surface of the platen body that is opposite to the recording medium with the space disposed between the surface of the platen body and the recording medium.

The support portion may have a plurality of plate-shaped ribs that are provided to extend upward on the platen body and in a feeding direction in which the recording medium is fed. The adhesive may be provided below the space formed between adjacent ribs of the plurality of ribs.

The recording head may be configured to perform a recording operation based on a set recording mode that is selected from a plurality of recording modes; and the control unit may contain a plurality of first predetermined gaps respectively corresponding to the plurality of recoding modes and may be configured to operate the gap adjusting unit to set the first predetermined gap according to the set recording mode.

The control unit may further contain a plurality of second predetermined gaps respectively corresponding to the plurality of recording modes; and the control unit may be configured to operate the gap adjusting unit to change the first predetermined gap to the second predetermined gap according to the set recording mode, when the specified timing arrives.

The recording head may be configured to reciprocate in a predetermined direction while ejecting the ink from the nozzle holes, to record the image on the surface of the recording medium.

The above and further objects and features of the invention will more fully be apparent from the following detailed description with accompanying drawings.

DETAILED DESCRIPTION OF THE PREFERRED EMBODIMENTS

Hereinafter, a recording apparatus according to an embodiment of the present invention will be described with reference to the accompanying drawings. By way of example, an ink jet printer will be described.

Figure 1:
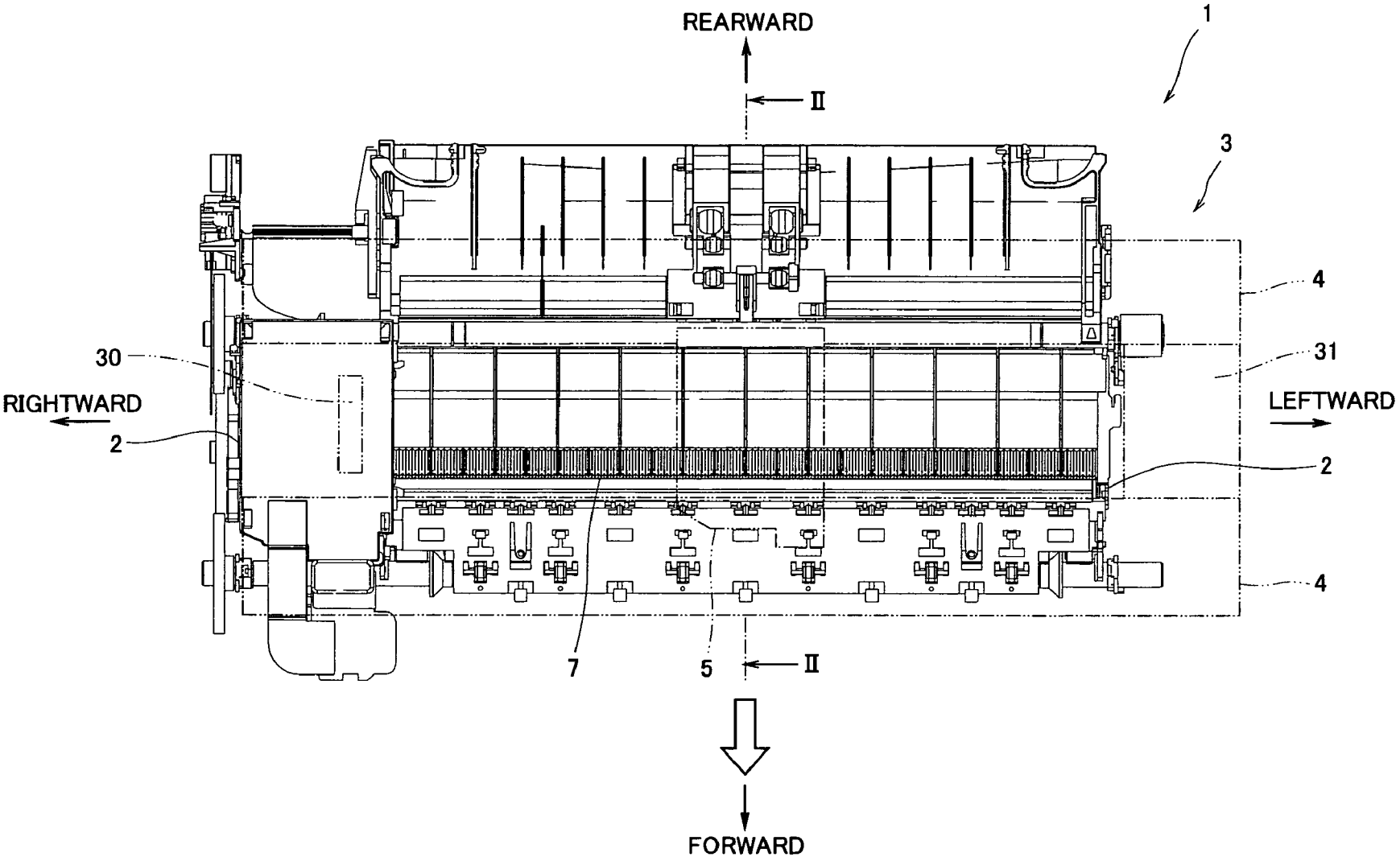
FIG. 1 is a plan view showing a structure of an ink jet printer according to an embodiment of the present invention, a part of which, for example, a housing covering the entire ink jet printer is omitted.

FIG. 1 is a plan view showing a structure of an ink jet printer according to an embodiment of the present invention, a part of which, for example, a housing covering the entire ink jet printer is omitted, for the sake of convenience of description. As shown in FIG. 1, an ink jet printer 1 has a pair of right and left main frames 2 formed of metal plates or the like. A recording unit 3 is provided between the main frames 2, for recording an image on recording paper (hereinafter referred to as paper) P which is being fed. In the description below, the directions are referenced such that a feeding direction (direction indicated by a while arrow in FIG. 1) of the paper P on which an image is being recorded by the recording unit 3 is forward, and the other cases will be described appropriately.

The recording unit 3 includes chassises 4 (indicated by two-dotted line in FIG. 1) arranged forward and rearward to bridge the main frames 2. The chassises 4 are of a plate shape extending rightward and leftward. A carriage 5 (indicated by two-dotted line in FIG. 1) is supported to be slid able rightward and leftward on the front and rear chassises 4 which are guide rails. A recording head 6 (see FIG. 2) is accommodated in the carriage 5. The carriage 5 is connected to a timing belt driven to move in a circumferential direction by a motor that is not shown. The carriage 5 is movable together with the recording head 6 in a longitudinal direction (rightward and leftward direction) of the chassises 4 according to an operation of the timing belt. A platen 7, which is elongated in the rightward and leftward direction as viewed from above, is disposed below the recording head 6 movable in this way.

The ink jet printer 1 accommodates an ink cartridge (not shown) in a housing. The ink cartridge is connected to the carriage 5 through ink supply pipes (not shown) so that inks of respective colors of black, cyan, magenta, and yellow are independently supplied to the recording head 6 inside the carriage 5. A control unit 40 (see FIG. 5) comprised of a CPU and others is accommodated in the housing. The control unit 40 is connected to the recording head 6 inside the carriage 5 via a flexible flat cable (not shown). The recording head 6 is capable of ejecting the inks of respective colors from nozzle holes based on a command signal from the control unit 40.

As shown in FIG. 1, a waste ink receiver 30 is disposed on a right side of the platen 7 that is outside of a region where the paper P is fed, for receiving the ink discharged during a flushing operation performed by the recording head 6. The recording head 6 is located above the waste ink receiver 30 and performs an ink discharge operation, i.e., a flushing operation in predetermined cycles during the recording operation, in order to prevent the nozzle holes from getting clogged with the ink. The waste ink receiver 30 receives the discharged ink.

A left-side region of the platen 7 that is outside of the region where the paper P is fed is a stand-by position of the carriage 5. A maintenance unit 31 for the recording head 6 is supported by the chassises 4. The maintenance unit 31 maintains the recording head 6 by cleaning a nozzle surface 6*a* (see FIG. 2) of the recording head 6 in the stand-by position by using a blade made of rubber or the like to remove adhering substances or matters and by selectively suctioning inks of the respective colors to prevent the nozzle holes from getting clogged with the ink.

Figure 2:
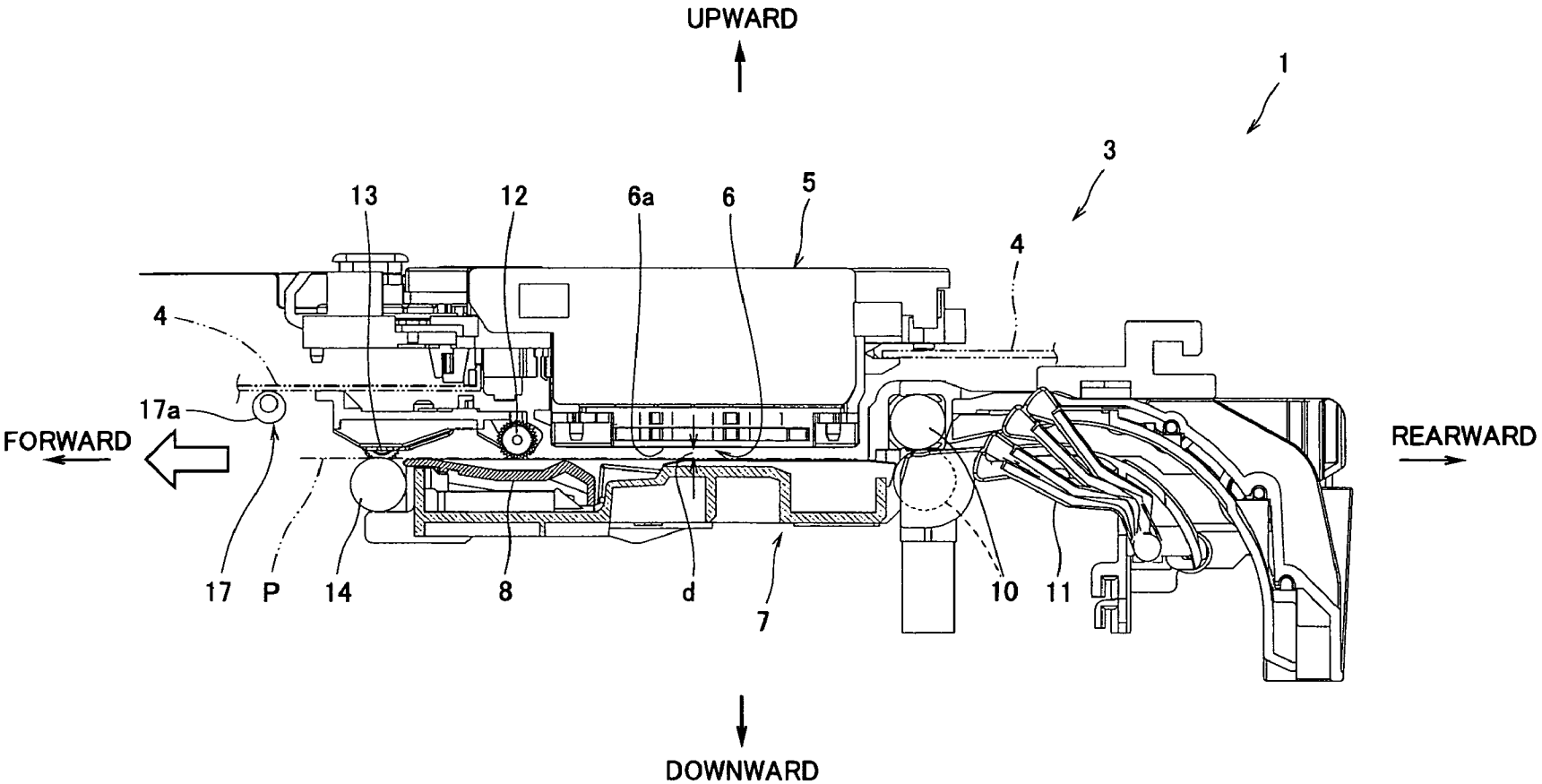
FIG. 2 is a cross-sectional view of the ink-jet printer taken in the direction of arrows along line II-II in FIG. 1, showing a structure of a recording unit.

FIG. 2 is a cross-sectional view of the ink-jet printer taken in the direction of arrows along line II-II in FIG. 1, showing a structure of the recording unit 3. As shown in FIG. 2, the ink jet printer 1 includes a pair of upper and lower resist rollers 10 disposed behind the platen 7, and a detection lever 11 disposed behind the resist rollers 10 for detecting a tip end of the paper P. The ink jet printer 1 according to the embodiment includes a cassette (not shown) disposed below the platen 7 for accommodating a number of sheets of paper P. The sheets of paper P inside the cassette are fed to the resist rollers 10 by a known feeding means via the detection lever 11.

The detection lever 11 is disposed to cross a feeding path of the paper P. The detection lever 11 is retractable outside of the feeding path of the paper P when a tip end of the paper P contacts the detection lever 11. When the detection lever 11 is retracted by the contact with the tip end of the paper P being fed, a sensor 11*a* (see FIG. 5) detects this, and outputs a signal indicating this to a control unit 40. The control unit 40 measures a time that lapses immediately after receiving the signal. After a lapse of a specified time, the control unit 40 outputs a signal to the recording head 6 to cause the ink to be ejected from the nozzle holes.

The resist rollers 10 are disposed with their rotational axes oriented in the rightward and leftward direction. The paper P that has been fed via the detection lever 11 is trapped into between the upper and lower resist rollers 10 and is fed further forward by the resist rollers 10. The paper P fed forward by the resist rollers 10 is guided into a space defined by the recording head 6 and the platen 7 with the paper P supported from a rear surface (lower surface) side by the platen 7, and recording is performed on a surface of the paper P in this space.

The platen cover 8 that is formed of a plate elongated in the rightward and leftward direction is provided above a front portion of the platen 7. A spur roller 12 having a rotational axis extending in the rightward and leftward direction is mounted above the platen cover 8. The spur roller 12 contacts the surface (upper surface) of the paper P being fed along the upper surface of the platen 7 and the upper surface of the platen cover 8, thereby preventing the paper P being subjected to recording from being displaced upward from the upper surface of the platen 7. A spur roller 13 and a paper discharging roller 14 are disposed in upper and lower positions forward of the platen 7. The rollers 13 and 14 are disposed with their rotational axes oriented in the rightward and leftward direction. The spur roller 13 and the paper discharging roller 14 rotate while trapping between the rollers 13 and 14 the paper P that has gone through recording on the platen 7 to guide the paper P that has gone through recording to an outlet (not shown) of the ink jet printer 1.

As shown in FIG. 2, an eccentric cam 17*a* forming a gap adjustment mechanism 17 is mounted in contact with a lower surface of the front chassis 4 under the front chassis 4. The eccentric cam 17*a* is connected via a gear to an output shaft of a motor 17*b* driven in accordance with a command from the control unit 40. The eccentric cam 17*a* rotates to vertically move the carriage 5 including the recording head 6 together with the chassis 4 closer to and away from the platen 7 so that a gap d between the recording head 6 and the platen 7 is adjusted as desired in a range between a distance d1 and a distance d2.

For example, in cases where a recording operation is performed with a high resolution by ejecting ink droplets of a relatively small volume, for example, a recording operation of photo image quality is performed with a high resolution by ejecting relatively small ink droplets, the gap d between the recording head 6 and the platen 7 is set to the distance d1 to improve adhesion position precision of ink ejected from the recording head 6. In contrast, in cases where a recording operation is performed at a relatively high speed by ejecting ink droplets of a relatively large volume, for example, normal printing is performed to create documents and others, the gap d can be set to a distance d3 (<d2) that is larger than the distance d1 to protect the nozzle surface 6*a* from contact with the paper P, or otherwise to the distance d2 larger than the distance d3 as desired.

Figure 3:
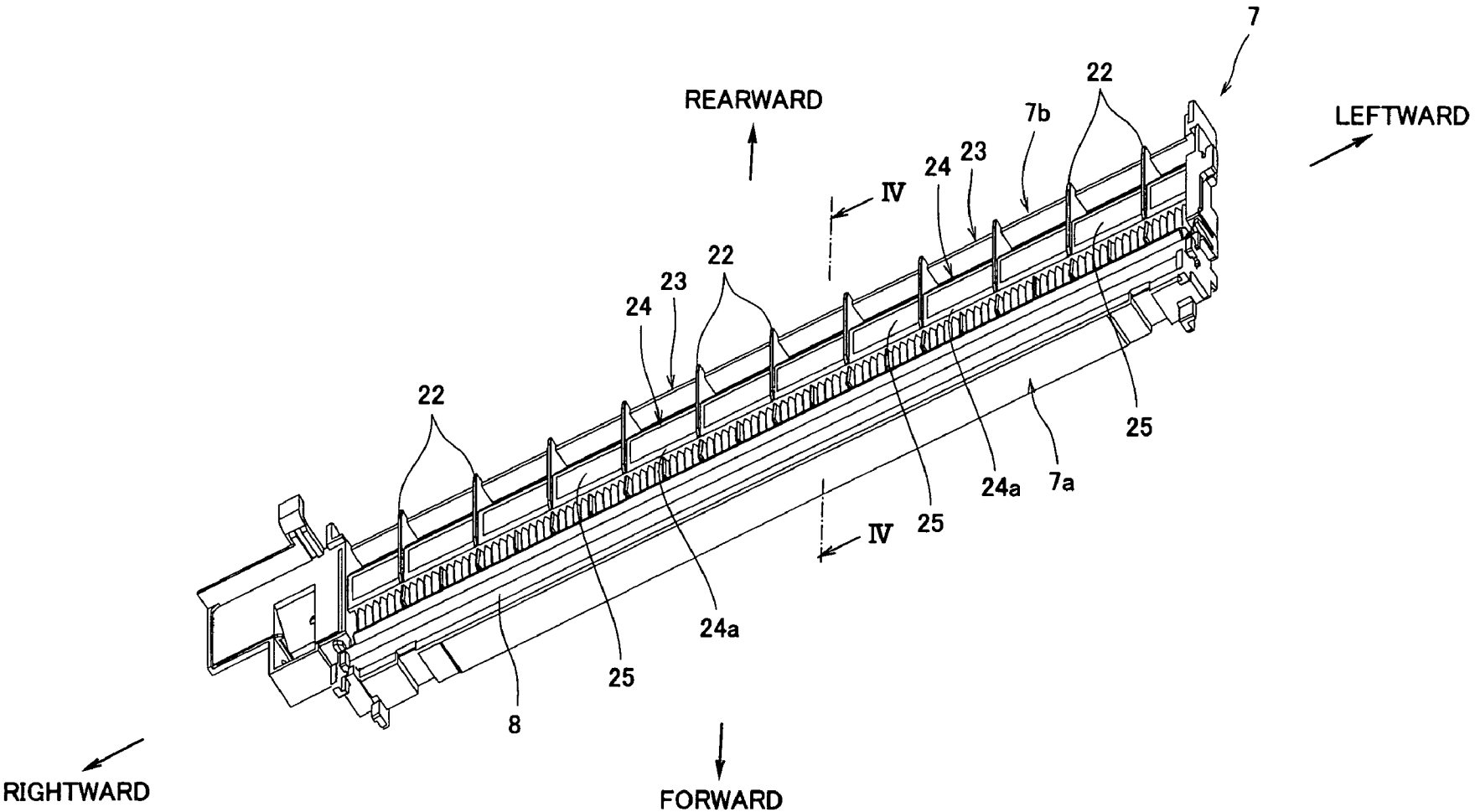
FIG. 3 is a perspective view of a platen with a platen cover attached thereon.
Figure 4:
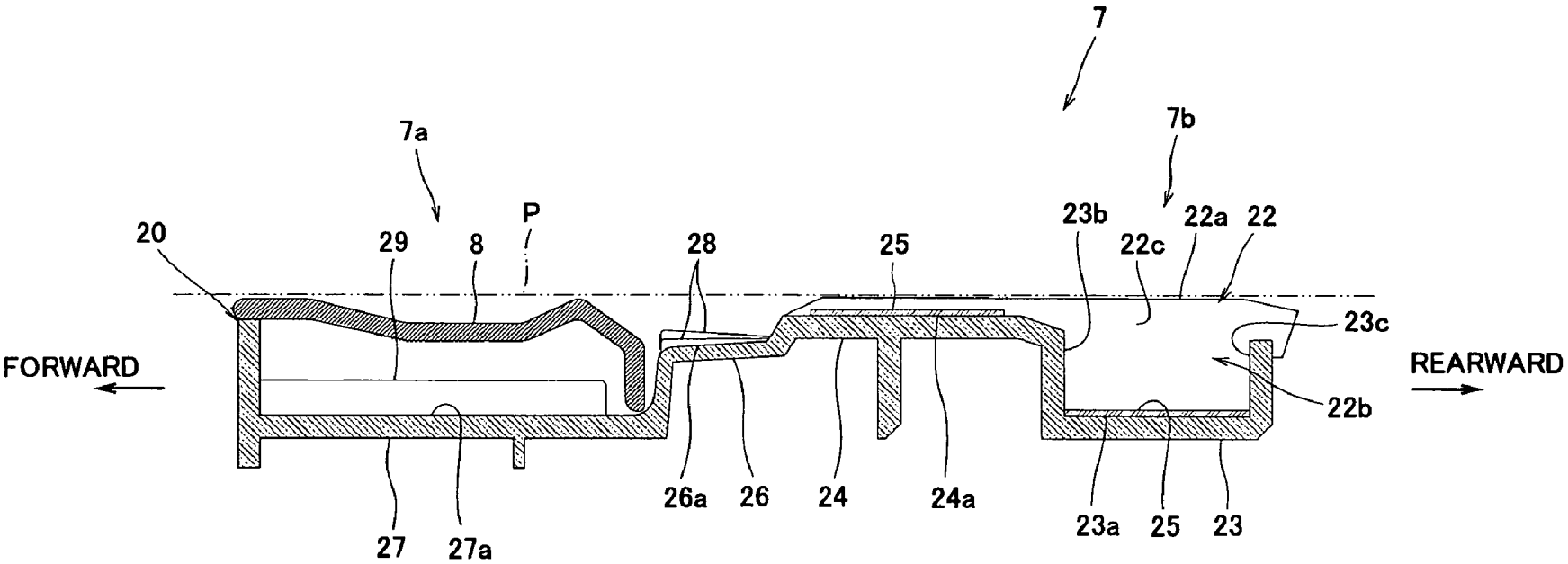
FIG. 4 is a cross-sectional view of the platen taken in the direction of arrows along line IV-IV of FIG. 3.

FIG. 3 is a perspective view of the platen 7 with the platen cover 8 attached thereon. FIG. 4 is a cross-sectional view of the platen 7 taken in the direction of arrows along line IV-IV of FIG. 3. As shown in FIG. 3, the platen 7 is a member that is made of synthetic resin and is of a substantially box shape elongated in the rightward and leftward direction as viewed from above. A front portion of the platen 7 forms an ink reservoir 7*a* for reserving excess ink that has not adhered to the paper P, and a rear portion thereof forms a paper support portion 7*b* for supporting the paper P from the rear surface side. The platen cover 8 covers the ink reservoir 7*a* of the platen 7 from above (see FIG. 2).

As shown in FIGS. 3 and 4, the platen 7 includes a platen body 20 and a plurality of upstream ribs 22 that are provided above the platen body 20 (closer to the recording head 6 or the paper P being subjected to recording than the platen body 20, for supporting the paper P from the rear surface side. The upstream ribs 22 are provided to extend upward on the platen body 20.

The platen body 20 is provided at a rear portion thereof with a concave plate portion 23 recessed downward. A shelf plate portion 24 of a flat plate shape is provided to extend forward continuously from the concave plate portion 23 such that the shelf plate portion 24 is opposite to a rear surface of the paper P. An upper surface of the shelf plate portion 24 is located higher than an inner bottom surface of the concave plate portion 23. The upstream ribs 22 are provided to extend from the concave plate portion 23 to the shelf plate portion 24.

More specifically, the upstream ribs 22 are plate shaped, and are arranged at constant intervals (intervals of about 20 mm in this embodiment) from a left end to a right end of the platen body 20. As shown in FIG. 4, the upstream ribs 22 are provided to extend upward from the inner bottom surface 23*a* of the concave plate portion 23 and from the upper surface 24*a* of the shelf plate portion 24, and from a rear end portion of the concave plate portion 23 to a front end portion of the shelf plate portion 24 in the feeding direction of the paper P.

Spaces 22*b* are formed between upper end portions (contact portions) 22*a* of adjacent upstream ribs 22 so as to expose the surface of the platen body 20, and thus, only the upper end portions (contact portions) 22*a* of the upstream ribs 22 directly contact the paper P from the rear surface side to support the paper P at a rear portion of the platen body 20. An adhesive layer 25 made of a specified adhesive is provided on the surface of the platen body 20 that is opposite to the paper P with the spaces 22*b* formed there between, i.e., the inner bottom surface 23*a* of the concave plate portion 23 and the upper surface 24*a* of the shelf plate portion 24. The upstream ribs 22, the concave plate portion 23 and the shelf plate portion 24 of the platen body 20, and the adhesive layer 25 form the paper support portion 7*b* of the platen 7.

An ink receiver 26 of a flat plate shape is provided at a front portion of the platen body 20 so as to extend forward continuously from the shelf plate portion 24. A concave ink recovery unit 27 that is recessed downward is provided in front of the ink receiver 26 to extend continuously from the ink receiver 26. The ink receiver 26 has an upper surface 26*a* that is slightly inclined downward in the forward direction. A plurality of downstream ribs 28 are provided to extend upward on the upper surface 26*a* of the ink receiver 26 and in the feed direction of the paper P, i.e., forward and rearward. The downstream ribs 28 are arranged in the rightward and leftward direction at constant intervals smaller than those of the upstream ribs 22 (see FIG. 3). A porous ink absorbing element 29 capable of absorbing ink is provided on the inner bottom surface 27*a* of the ink recovery unit 27. The ink receiver 26, the ink recovery unit 27, the downstream ribs 28, and the ink absorbing element 29 form the ink reservoir 7*a* of the platen 7.

In the ink jet printer 1 constructed above, the adhesive layer 25 provided on the upper surface of the platen 7 captures the paper powder generated from the paper P. Since the adhesive layer 25 is provided on the surface of the platen 7 that is opposite to the recording head 6, i.e., the inner bottom surface 23*a* of the concave plate portion 23 and the upper surface 24*a* of the shelf plate portion 24, in a location below the upstream ribs 22 that directly contact the paper P, it can capture the paper powder efficiently.

Whereas in the platen 7 shown in FIG. 4, the adhesive layer 25 is provided on the inner bottom surface 23*a* of the concave plate portion 23 and the upper surface 24*a* of the shelf plate portion 24, it is not intended to be limited to this. Alternatively, the adhesive layer 25 may be provided on a front vertical wall surface 23*b* (see FIG. 4) connecting the inner bottom surface 23*a* of the concave plate portion 23 to the upper surface 24*a* of the shelf plate portion 24, or a rear vertical wall surface 23*c* (see FIG. 4) of the concave plate portion 23 that is opposite to the front vertical wall surface 23*b*. Furthermore, alternatively, the adhesive layer 25 may be provided on right and left surfaces of the upstream ribs 22.

In the ink jet printer 1 according to the embodiment, the platen 7 has the ink reservoir 7*a*. In the ink reservoir 7*a*, excess ink remaining unadhered onto the paper P when so-called edgeless printing is carried out is guided to the ink recovery unit 27 through grooves formed between adjacent downstream ribs 28 and is absorbed in the ink absorbing element 29. This makes it possible to prevent the excess ink from contaminating the paper P.

Figure 5:
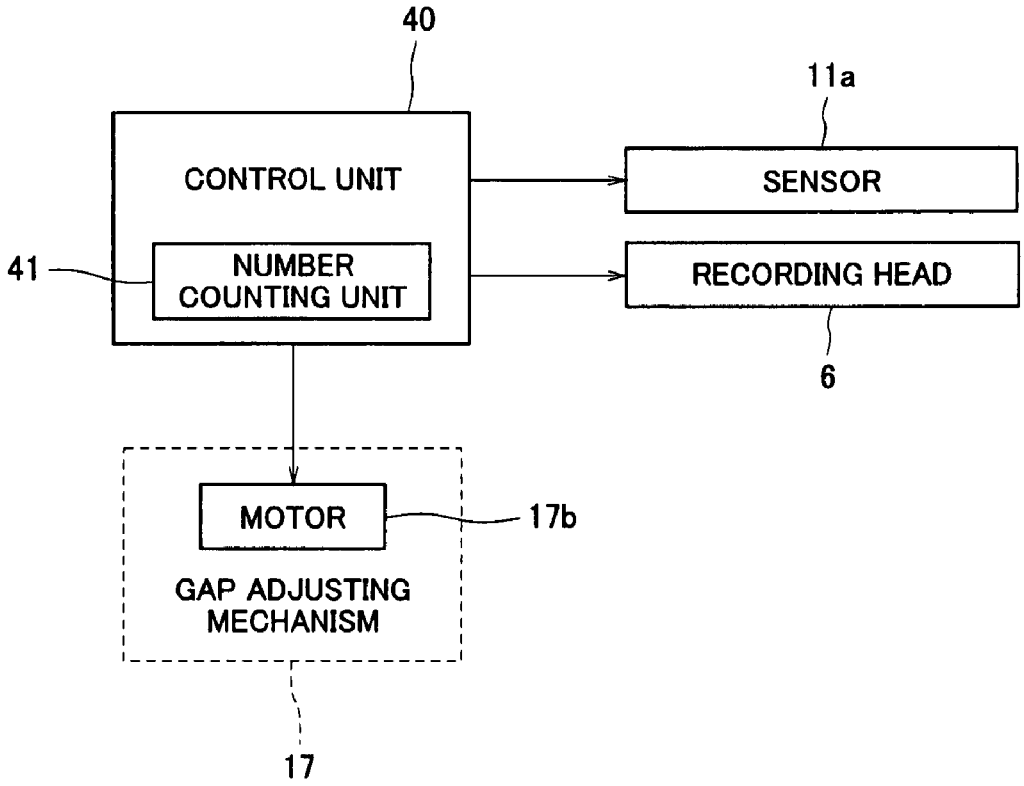
FIG. 5 is a block diagram showing a function of a part of the ink-jet printer, for moving up and down the recording unit in a configuration in which a control unit serves as a number counting unit.

Subsequently, a function of a part of the above described ink jet printer 1, for moving up and down the recording head 6 will be described with reference to a block diagram shown in FIG. 5. As shown in FIG. 5, the ink jet printer 1 includes the control unit 40 comprised of the CPU, the memories, and others. The control unit 40 operates according to programs stored in the memory to serve as a number counting unit 41 for counting the number of papers P subjected to recording, which is a value indicating recording amount of the paper P.

For example, when the control unit 40 operates according to the flowchart of FIG. 6 described later, it operates as the number counting unit 41 in step S15. Also, when the control unit 40 serves as a time measuring unit 42 or a scanning number counting unit 43, it measures a recording operation time or counts the scanning number based on a signal output from the control unit 40 to the recording unit 6 via the flexible flat cable.

As shown in FIG. 5, the motor 17*b* forming the gap adjustment mechanism 17 is connected to the control unit 40 via a drive circuit (not shown). The motor 17*b* rotates the output shaft by a specified rotational angle based on a command signal from the control unit 40 so that the gap d between the nozzle surface 6*a* of the recording head 6 and the platen 7 is set between the distance d1 and the distance d2. In this embodiment, the gap d is, as shown in FIG. 2, a distance from the contact portions 22*a* of the upstream ribs 22 of the platen 7 to the nozzle surface 6*a*.

The control unit 40 controls operation of the other parts in the ink jet printer 1. For example, the control unit 40 is communicatively coupled to the sensor 11*a* for detecting the tip end of the paper P and decides the recording operation to be performed on the paper P at a timing based on a signal from the sensor 11*a*. Furthermore, the control unit 40 controls the operation of the ink jet printer 1, such as the flushing operation in the waste ink receiver 30 or the maintenance process in the maintenance unit 31.

Figure 6:
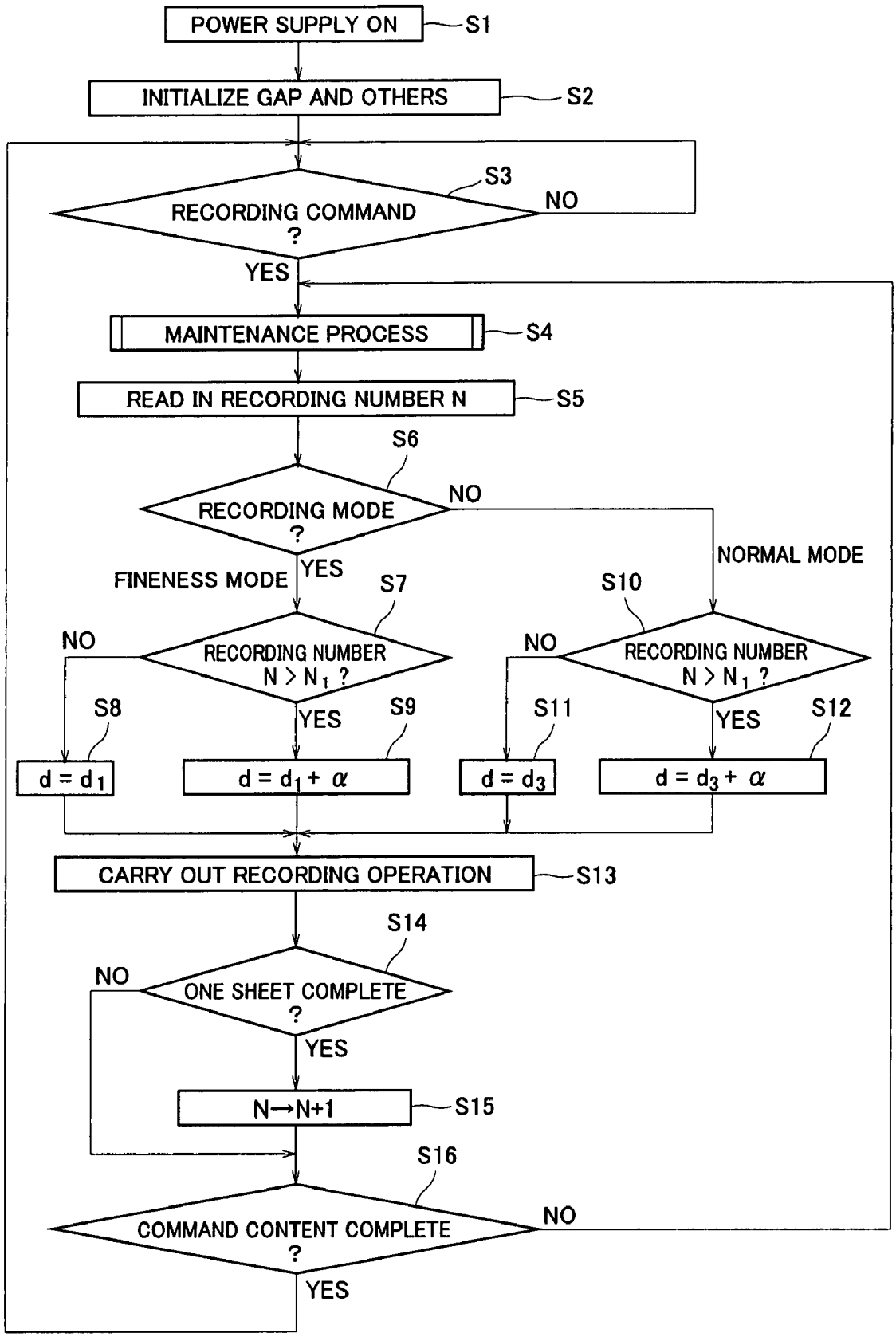
FIG. 6 is a flowchart showing an example of an operation performed by the ink jet printer to adjust a gap between a nozzle surface of the recording head and the platen.
Figure 7:
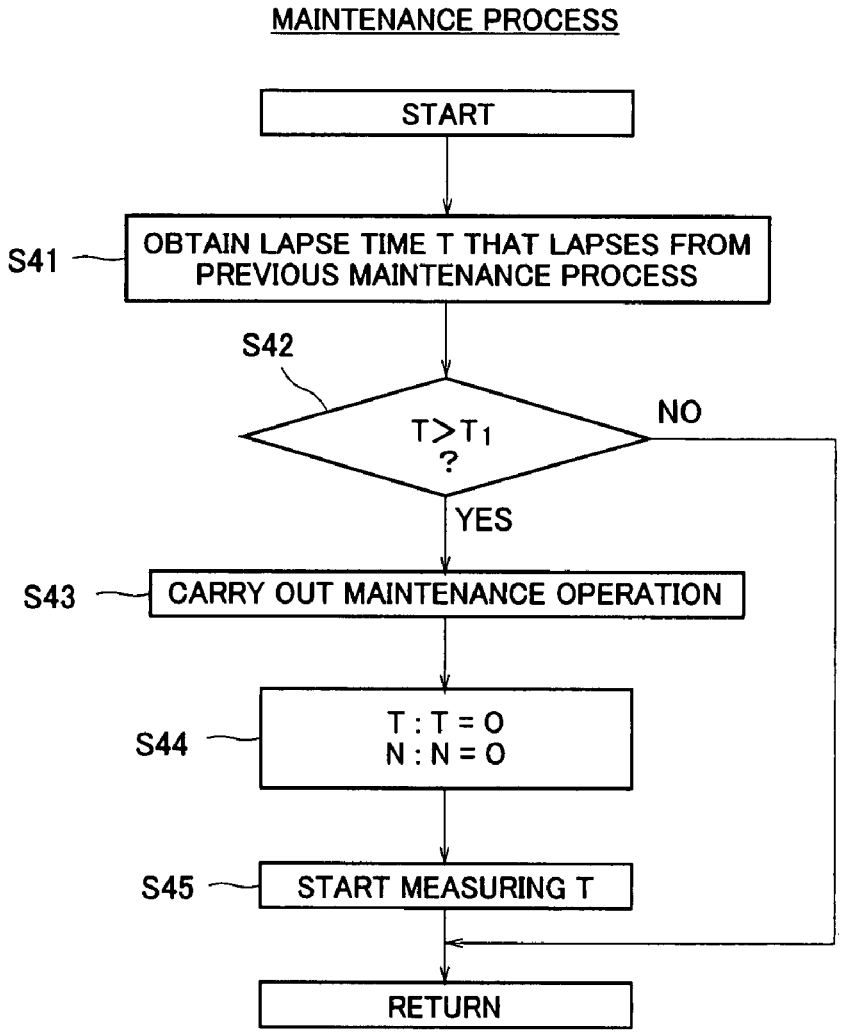
FIG. 7 is a flowchart showing a sub-routine associated with a maintenance process which is a part of the operation of FIG. 6.

FIG. 6 is a flowchart showing an example of an operation performed by the ink-jet printer 1 to adjust the gap d between the nozzle surface 6*a* of the recording head 6 and the platen 7. FIG. 7 is a flowchart showing a sub-routine associated with the maintenance process which is a part of the operation of FIG. 6. In the operation of FIGS. 6 and 7, the control unit 40 operates as the number counting unit 41 as described below.

As shown in FIG. 6, first, a power supply of the ink jet printer 1 is turned on (S1). The control unit 40 initializes the gap d between the nozzle surface 6*a* of the recording head 6 and the platen 7 to a preset reference gap d0 (S2). The reference gap d0 can be set between the distance d1 and the distance d2 as desired. Then, the control unit 40 determines whether or not there is a recording command, i.e., a command for recording operation, to be specific, whether or not an operator has operated an input panel or the like suitably provided on the ink jet printer 1, or there is a command from a computer communicatively coupled to the ink jet printer 1 (S3). If the control unit 40 determines that there is no recording command (S3: NO), it repeats an operation in step S3. On the other hand, if the control unit 40 determines that there is a recording command (S3: YES), it transitions to the maintenance process (S4).

As illustrated in a sub-routine in FIG. 7, first, the control unit 40 obtains a time T that lapses from a previous maintenance process (S41). To be specific, first, the control unit 40 reads in from the memory therein, the time T that has lapsed from the completion of the previous maintenance process for the recording head 6 performed by the maintenance unit 31. The control unit 40 determines whether or not the time T is larger than a preset time value T1 (S42). If the control unit 40 determines that the time T is larger than the preset time value T1 (S42: YES), it outputs a command signal to the maintenance unit 31 to cause the maintenance unit 31 to carry out the maintenance operation on the nozzle surface 6*a* of the recording head 6 (S43). The maintenance operation means a cleaning operation performed on the nozzle surface 6*a* of the recording head 6 in such a manner that inks of respective colors are suctioned through the nozzle holes or contamination is removed from the nozzle surface 6*a* by using a blade or the like.

After carrying out the maintenance operation, the control unit 40 resets the time T stored in the memory to zero, and resets to zero a recording number N stored in the memory, relating to the recording number after the maintenance process (S44). The control unit 40 starts measuring the lapse time T again (S45) and terminates the sub-routine associated with the maintenance process. If the control unit 40 determines that the lapse time T is not larger than the preset time value T1 (S42: NO) in step S42, it also terminates the sub-routine associated with the maintenance process.

After finishing the sub-routine associated with the maintenance process, the control unit 40 obtains the recording number N stored in the memory (S5), and then selects a recording mode to be executed (S6). In this embodiment, as the recording mode, a fineness mode which is the recording mode for the photo image quality, and a normal mode which is the recording mode for printing to create documents are set.

If the control unit 40 determines that the recording mode to be executed is the fineness mode in step S6, it further determines whether or not the recording number N obtained in step S5 is larger than a predetermined value N1 (S7). If the control unit 40 determines that the recording number N obtained in step S5 is not larger than the predetermined value N1 (S7: NO), it sets the gap d to the distance d1 for the recording in the fineness mode (S8). On the other hand, if the control unit 40 determines that the recording number N obtained in step S5 is larger than the predetermined value N1 (S7: YES), it rotates the motor 17*b* to drive the gap adjustment mechanism 17 so that the gap d is set to a distance (d1+α) that is larger than the distance d1 (d1+α<d2) (step S9). Under this condition, the recording operation is carried out (S13). As used herein, the term "recording operation" refers to one scanning which is a reciprocating operation of the recording head 6 along the chassises 4.

On the other hand, if the control unit 40 determines that the recording mode to be executed is the normal mode in step S6, it further determines whether or not the recording number N obtained in step S5 is larger than a predetermined value N1 (S10). If the control unit 40 determines that the recording number N is not larger than N1 (S10: NO), it sets the gap d to the distance d3 (d3>d1) for recording in the normal mode (S11). On the other hand, if the control unit 40 determines that the recording number N is larger than N1 (S10: YES), it rotates the motor 17*b* to drive the gap adjustment mechanism 17 so that the gap d is set to a distance (d3+a) that is larger than the distance d3 (d3+a≦d2) (step S12). Under this condition, the recording operation is carried out (S13).

When the recording operation corresponding to one scanning is complete in step S13, the control unit 40 determines whether or not recording of one sheet of paper P is complete, based on a signal indicating a recording content output from the control unit 40 to the recording head 6 or a detection signal from the sensor 11*a* (S14).

If the control unit 40 determines that recording of one sheet of paper P is complete in step S14 (S14: YES), the control unit 40 adds one to the value of the recording number N stored in the memory (S15). If the control unit 40 determines that recording of one sheet of paper P is not complete yet (S14: NO), it keeps the recording number N stored in the memory as it is. After the control unit 40 determines that recording of one sheet of paper P is not complete yet (S14: NO), and performs step S15, it further determines whether or not the operation based on the recording command received in step S13 is complete (S16). If the control unit 40 determines that the operation based on the recording command is complete (S16: YES), it executes the operation in step S3 and the following steps. On the other hand, if the control unit 40 determines that the operation based on the recording command is not complete yet (S16: NO), it executes the operation in step S4 and the following steps. In step S15, the control unit 40 operates as the number counting unit 41.

In accordance with the operation of the ink jet printer 1 described above, when the gap for a recording mode (e.g., d1 and d3: first gap) is set in a routine (step S8 and S11), the control unit 40 changes the gap d to the gap larger than the gap d (e.g., d1+α, d3+α: second gap) (step S9 and S12), if the control unit 40 determines that the recording number N is larger than the predetermined value N1 in the following routine (S7 and S10: YES). After changing the gap d, adhesion of the paper powder onto the nozzle surface 6*a* of the recording head 6 can be suppressed.

Whereas in the flowchart of FIG. 6, the gap d is set to d3+α even in the case where the recording number N is larger than the predetermined value N1 in the normal mode, it is not necessary to change the gap d=d3 set for the normal mode if this gap d=d3 is relatively large. In this case, therefore, steps S10 and 12 may be omitted, and when the normal mode is selected in step S6, the recording operation may be carried out in step S13 after the step S11.

Figure 8A:
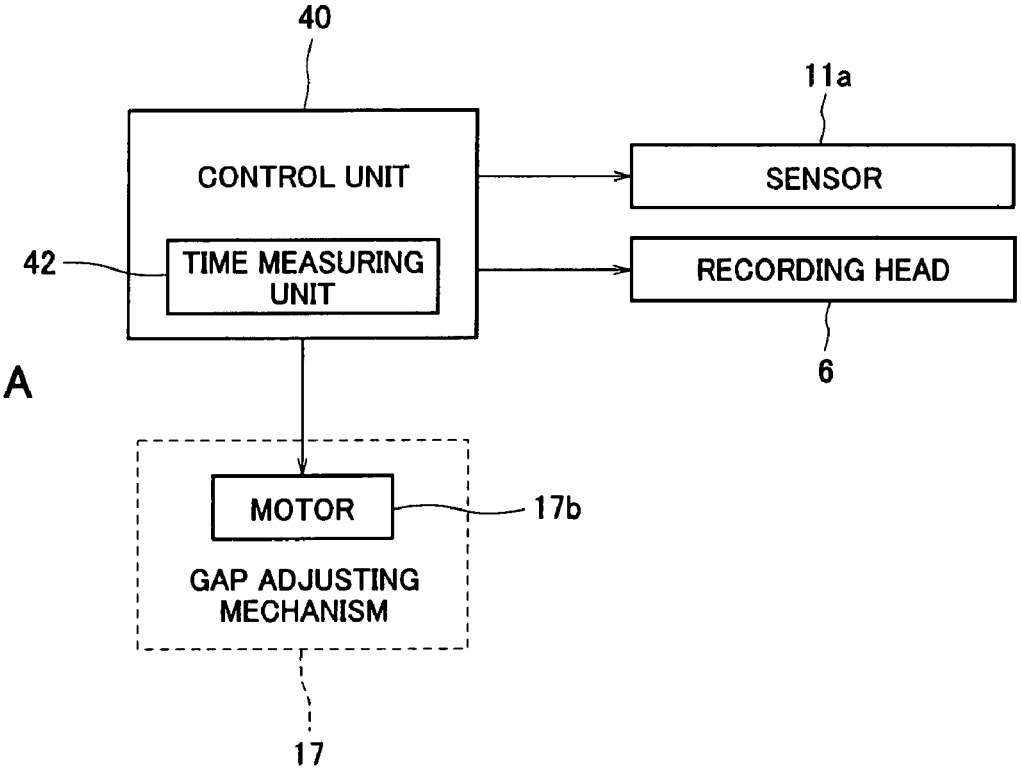
FIG. 8A is a block diagram showing a function of a part of the ink-jet printer, for moving up and down the recording unit in a configuration in which the control unit serves as a time measuring unit.

Whereas in the above description, the gap d is adjusted based on the value of the recording number N, this is merely exemplary. For example, the gap d may be adjusted based on the operation time T of the recording head 6 after the previous maintenance process. In this case, a function of a part of the above described ink jet printer 1, for moving up and down the recording head 6 is configured as illustrated in FIG. 8A, showing that the time measuring unit 42 replaces the number counting unit 41 shown in FIG. 5. In this case, the control unit 40 reads in the time T instead of the recording number N in step S5 in the flowchart of FIG. 6, and determines whether or not the time T is larger than a predetermined value T2 (T2<T1) in step S7 and S10. Also, steps 14 and 15 may be omitted.

Figure 8B:
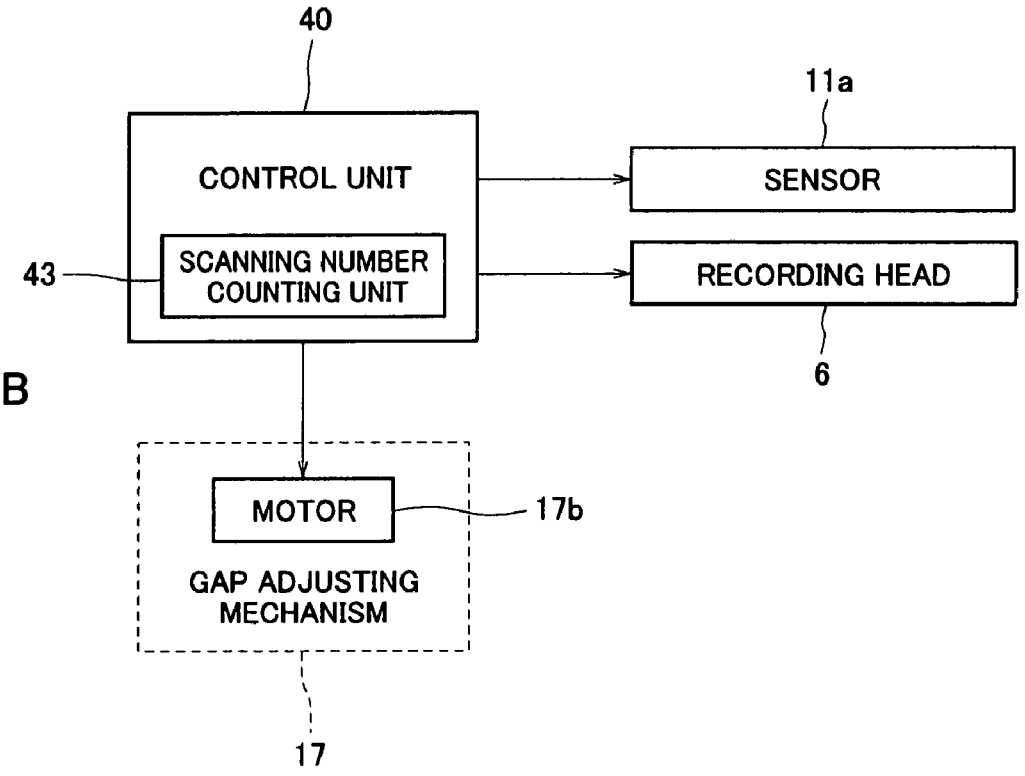
FIG. 8B is a block diagram showing a function of a part of the ink-jet printer, for moving up and down the recording unit in a configuration in which the control unit serves as a scanning number counting unit.

Furthermore, the gap d may be adjusted based on the number of scanning performed by the recording head 6 after the previous maintenance process. In this case, a function of a part of the ink jet printer 1, for moving up and down the recording head 6 is configured as illustrated in FIG. 8B, showing that the scanning number counting unit 43 replaces the number counting unit 41 shown in FIG. 5. In this case, the control unit 40 executes the steps along the flowchart of FIG. 6 in which the recording number has been replaced by the scanning number. Also, the steps S14 and S15 may be omitted.

The control unit 40 may be configured to be able to execute any ones of the number counting unit 41, the time measuring unit 42, and the scanning number measuring unit 43.

Moreover, for the purpose of adjusting the gap d between the platen 7 and the recording head 6, the platen 7 may be configured to be movable close to and away from the recording head 6, or both of the platen 7 and the recording head 6 may be configured to be movable relatively to be close to and away from each other.

While in the above described embodiment, the recording unit 3 has the recording head 6 mounted to the carriage 5, the present invention is not intended to be limited to this configuration. For example, the recording unit may include a recording head which has nozzle rows that are formed by a plurality of nozzle holes arranged in the width direction of the paper P and that extend longer than the width of the paper P, and which is configured not to be movable in the width direction of the paper P. That is, the recording unit may include so-called a line-type recording head.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A recording apparatus comprising:

a recording head for ejecting ink from nozzle holes formed on a nozzle surface to record an image on a surface of a recording medium, the nozzle surface being placed opposite to the recording medium;

a platen disposed opposite to the recording head, for supporting the recording medium from a rear surface side;

a cleaner for cleaning the nozzle surface of the recording head in predetermined cycles;

a gap adjusting unit for adjusting a gap between the nozzle surface of the recording head and the platen in such a manner that one of or both of the recording head and the platen is moved; and a control unit for controlling an operation of the gap adjusting unit; wherein the control unit includes a measuring unit for measuring a value indicating a recording amount of recording performed on the recording medium, and wherein the control unit is configured to, in a state where the gap between the nozzle surface and the platen is set to a first predetermined gap, change the first predetermined gap to a second predetermined gap larger than the first predetermined gap when a specified timing at which the value indicating the recording amount exceeds a predetermined value arrives after the cleaner has cleaned the nozzle surface.

2. The recording apparatus according to claim 1, wherein the measuring unit is configured to measure a recording number of the recording medium;

and wherein the timing arrives when the recording number of the recording medium that is measured by the measuring unit becomes a predetermined value after the cleaner has cleaned the nozzle surface.

3. The recording apparatus according to claim 1, wherein the measuring unit is configured to measure a recording time during which the recording medium is subjected to recording;

and wherein the timing arrives when the recording time that is measured by the measuring unit becomes a predetermined value after the cleaner has cleaned the nozzle surface.

4. The recording apparatus according to claim 1, wherein the control unit is configured to operate the gap adjusting unit to change the second predetermined gap between the nozzle surface and the platen to the first predetermined gap, when the cleaner cleans the nozzle surface in a state where the gap between the nozzle surface and the platen is set to the second predetermined gap.

5. The recording apparatus according to claim 1, wherein the platen includes a platen body and a support portion that is provided closer to the recording medium than the platen body, for supporting the recording medium;

wherein the support portion has a plurality of contact portions that contact a rear surface of the recording medium, and a space is formed between the contact portions so as to expose a surface of the platen body;

and wherein an adhesive is provided on the surface of the platen body that is opposite to the recording medium with the space disposed between the surface of the platen body and the recording medium.

6. The recording apparatus according to claim 5, wherein the support portion has a plurality of plate-shaped ribs that are provided to extend upward on the platen body and in a feeding direction in which the recording medium is fed; and wherein the adhesive is provided below the space formed between adjacent ribs of the plurality of ribs.

7. The recording apparatus according to claim 1, wherein the recording head is configured to perform a recording operation based on a set recording mode that is selected from a plurality of recording modes; and wherein the control unit contains a plurality of first predetermined gaps respectively corresponding to the plurality of recoding modes and is configured to operate the gap adjusting unit to set the first predetermined gap according to the set recording mode.

8. The recording apparatus according to claim 7, wherein the control unit further contains a plurality of second predetermined gaps respectively corresponding to the plurality of recording modes; and wherein the control unit is configured to operate the gap adjusting unit to change the first predetermined gap to the second predetermined gap according to the set recording mode, when the specified timing arrives.

9. The recording apparatus according to claim 1, wherein the recording head is configured to reciprocate in a predetermined direction while ejecting the ink from the nozzle holes, to record the image on the surface of the recording medium.

* * * * *